US005704815A

United States Patent [19]

Shibata et al.

[11] Patent Number: 5,704,815

[45] Date of Patent: Jan. 6, 1998

[54] TERMINAL DEVICE FOR ELECTRICAL APPARATUS

[75] Inventors: Katsumi Shibata; Takato Hirota; Makoto Kawasaki; Etsuya Hiramatsu, all of Kawasaki, Japan

[73] Assignee: Fuji Electric Co., Ltd., Kanagawa, Japan

[21] Appl. No.: 629,376

[22] Filed: Apr. 8, 1996

[30] Foreign Application Priority Data

Apr. 11, 1995 [JP] Japan ..... 7-085053

[51] Int. Cl.[6] ..... H01R 9/24

[52] U.S. Cl. ..... 439/709; 439/813

[58] Field of Search ..... 439/709, 801, 439/813, 718

[56] References Cited

U.S. PATENT DOCUMENTS

| | | | |
|---|---|---|---|
| 4,830,627 | 5/1989 | Heng et al. | 439/586 |
| 5,266,058 | 11/1993 | Sako et al. | 439/813 |
| 5,376,024 | 12/1994 | Sako et al. | 439/813 |

FOREIGN PATENT DOCUMENTS

| | | |
|---|---|---|
| 0123910 | 11/1984 | European Pat. Off. . |
| 0535507 | 4/1993 | European Pat. Off. . |
| 60-130068 | 7/1985 | Japan . |
| 62-48640 | 3/1987 | Japan . |
| 3-7028 | 2/1991 | Japan . |
| 4-4707 | 1/1992 | Japan . |
| 6-60919 | 3/1994 | Japan . |

*Primary Examiner*—Gary F. Paumen

*Attorney, Agent, or Firm*—Pearne, Gordon, McCoy & Granger LLP

[57] ABSTRACT

A terminal device for connecting contacts to terminal strips fixed on respective terminal housing portions of an electrical apparatus, each of the terminal strips having a screw hole, the terminal housing portions being separated by insulating walls from one another. The terminal device includes a plurality of terminal screws, each including a male screw, and an L-shaped washer supported loosely and rotatably on the male screw and having a guide plate portion extending opposite to the terminal strip; a terminal cover covering the terminal housing portions and having round holes for handling the respective terminal screws; a guiding portion each including a vertical trench formed on a side plate of the terminal cover and having an opening facing the round hole, for guiding the guide plate portion slidably to and from the terminal strip along the vertical trench; a plurality of coupling claws, each disposed between the round hole and the male screw, for holding the terminal screw such that a tip of the male screw is spaced from the terminal strip for a certain distance; and a swinging mechanism for releasing the guide plate portions from the guiding portions, respectively, when the tips of the male screws are coupled to the respective terminal strips, to allow the washers to swing.

3 Claims, 6 Drawing Sheets

TERMINAL DEVICE FOR ELECTRICAL APPARATUS

BACKGROUND OF THE INVENTION

1. Field of the Invention

The present invention relates to a terminal device for an electrical apparatus, which facilitates connecting an annular crimp contact without disengaging a terminal screw from a terminal board of the electrical apparatus.

2. Description of the Related Art

There has been known the conventional terminal devices incorporated into an electrical apparatus such as an electromagnetic contactor or electromagnetic switch, for connecting electric conductors to the electrical apparatus. Such conventional terminal devices include fixed terminals (hereinafter referred to as "terminal strips"), each having a screw hole; male screws coupled to the terminal strips; and washers loosely supported by the male screws. Hereinafter, the assembled male screw and washer may be collectively referred to as a "terminal screw". An electric conductor is connected to the electrical apparatus by inserting the electric conductor between the terminal strip and the washer and by tightening up the male screw. When one wants to connect an electric conductor provided with an annular crimp contact having a round hole to the terminal device, it is necessary to disengage the once tightened male screw from the terminal strip, insert the male screw into the round hole of the crimp contact, and then tighten up the male screw into the screw hole of the terminal strip. Among the connecting works, it takes time to disengage the once tightened male screw from the terminal strip. Moreover, the risk of dropping the disengaged male screw can not be ruled out. Once the disengaged male screw is dropped, it will take additional time to find and pick up the dropped male screw, and the efficiency of connecting work will be lowered. To obviate the drawbacks, some improved terminal devices have been proposed.

FIG. 11 is a schematic cross-sectional view showing a main part of an example of the conventional terminal devices for an electronic apparatus. Referring to FIG. 11, a terminal strip 51 is fixed to a frame, made of an insulating material, of the terminal device. The terminal strip 51 has a screw hole 51A. A male screw 52 to be coupled to the screw hole 51A has a head 52A. A washer 53 is supported loosely enough to be rotatable on a neck formed in the vicinity of the head 52A of the male screw 52. A terminal cover 54, which covers the terminal device for preventing electrification, has a round hole 55 for accepting a screwdriver for tightening and loosening the male screw 52. The round hole 55 is so defined as to be a little bit larger in diameter than the head 52A of the male screw 52. A supporting chip 56, which couples with the bottom surface of the head 52A so as to support the male screw 52, protrudes from the lower edge of the round hole 55. The supporting tip 56 supports the male screw 52 such that the tip of the male screw 52 is located high for a spacing of H above the terminal strip 51. The terminal device is shipped in this state. Therefore, this conventional terminal device, disclosed in Japanese Unexamined Laid Open Patent Application No. Sho 60-130068, facilitates connecting the electric conductor to the terminal device, without loosening the male screw 52, by pressing down the terminal screw having the male screw 52 engaging the annular crimp contact, and by tightening up the male screw 52.

FIG. 12 is a schematic cross-sectional view showing a main part of another conventional terminal device disclosed in Japanese Examined Patent Publication No. Hei 4-4707. FIG. 13 is a perspective view showing the terminal screw of FIG. 12. Referring to FIGS. 12 and 13, a terminal board as the terminal device has a terminal strip 51 fixed to a frame 58 made of an insulating material. The terminal strip 51 has a round hole 51A. A male screw 52 to be coupled to the screw hole 51A has a head 52A. An L-shaped washer 57 is supported loosely enough to be rotatable on a neck formed near the head 52A of the male screw 52. The male screw 52 and the washer 57 constitute a terminal screw 60. The L-shaped washer 57 consists of a washer portion 57A through which the male screw 52 is inserted and a vertical plate portion 57B bent with an L-shape. The vertical plate portion 57B is coupled with a guiding trench 58A formed on the frame 58 such that the male screw 52 is guided to the terminal strip 51 for an adjustable distance which facilitates tightening up and loosening the male screw 52 to and from the terminal strip 51. A plate spring 59 is disposed behind the terminal strip 51 such that the tip of the male screw 52 and the surface of the terminal strip 51 are spaced from each other by a spacing H when the plate spring 59 and the vertical plate portion 57B couple with each other at their tips. This conventional terminal device also facilitates connecting the electric conductor thereto, without loosening the male screw 52, by pressing down the terminal screw having the male screw 52 engaging the annular crimp contact, and by tightening the male screw 52.

The terminal device of FIG. 11 eliminates the work of disengaging the terminal screw from the terminal strip for connecting the annular crimp contact, since the terminal device of FIG. 11 is supplied to the customers in the state that the terminal screws are held on the terminal cover. However, once the head of the male screw, inserted to the round hole of the annular crimp contact, is released from the supporting chip, the male screw is guided to the screw hole of the terminal strip while the terminal screw is supported by an electric conductor and screwdriver. This makes it difficult to tighten up the male screw. If the electric conductor is carelessly pulled, the terminal screw may fall out from the terminal device. When the terminal screw is loosened from the terminal strip for rewiring or for additional wiring, it is difficult to couple the screw head with the supporting chip to hold the terminal screw. Since it is also necessary to remove the terminal cover from the frame in this occasion, the working efficiency is greatly lowered.

In the terminal device of FIGS. 12 and 13, the terminal screw is held at a predetermined position by the plate spring. While the tip of the male screw is inserted into the round hole of the annular crimp contact and the L-shaped washer is released from the plate spring, the vertical plate portion of the L-shaped washer couples with the guiding trench of the frame to guide the tip of the male screw towards the screw hole of the terminal strip. Therefore, it is unnecessary to disengage the terminal screw from the terminal strip prior to connecting the annular crimp contact. The screw terminal may be tightened up or loosened to be held at a predetermined position quite efficiently. However, since the plate spring is used, the number of constituent parts and elements increases. Since it is necessary to secure a space for housing the plate spring and the vertical plate portion of the L-shaped washer behind the terminal strip, the terminal device of FIGS. 12 and 13 is not adaptable to the electrical apparatus which does not have any leeway for the space, such as electromagnetic switches and so on. The vertical plate portion of the L-shaped washer is coupled with the guiding trench such that the movable direction of the vertical plate portion is limited. Therefore, when the ends of two conductors, different in diameter from each other, are connected in parallel, the L-shaped washer does not tilt to cause insufficient cramping force for the conductor with smaller diameter. If the male screw is tighten up forcibly to obtain sufficient cramping force, the vertical plate portion of the L-shaped washer may be deformed at its base.

SUMMARY OF THE INVENTION

In view of the foregoing, it is an object of the invention to provide a small terminal device for an electrical apparatus which facilitates connecting, easily, securely and highly efficiently, electric conductors having different diameters in parallel thereto.

According to the present invention, there is provided a terminal device for connecting annular crimp contacts to terminal strips fixed on respective terminal housing portions of an electrical apparatus, each of the terminal strips having a screw hole, the terminal housing portions being separated by insulating walls from one another, the terminal device comprising:

terminal screws, each including a male screw, and an L-shaped washer supported loosely and rotatably on the male screw and having a guide plate portion extending opposite to the terminal strip;

a terminal cover covering the terminal housing portions and having round holes for handling the respective terminal screws; guiding means, each including a vertical trench formed on the terminal cover side plate and having an opening facing the round hole, for guiding the guide plate portion slidably to and from the terminal strip along the vertical trench;

coupling claws, each disposed between the round hole and the male screw, for holding the terminal screw such that the male screw's tip is spaced from the terminal strip for a certain distance; and swinging means for releasing the guide plate portions from the respective guiding portions when the male screw's tips are coupled to the respective terminal strips, to whereby allow the L- shaped washers to swing.

Advantageously, each of the swinging means comprises a first swinging mechanism including taper portions formed on both sides of the guide plate portion of the L-shaped washer such that the guide plate portion's width narrows toward the guide plate portion's upper edge.

Advantageously, each of the swinging means comprises:

a second swinging mechanism including the guide plate portion formed of thin side portions, a thick central portion and step portions formed between the thin side and thick central portions, and taper portions formed on a side of each of the thin side portions such that the guide plate portion's width narrows toward the upper edge thereof; and a third swinging mechanism including the vertical trench, thereto the thin side portions and the step portions are coupled to facilitate guiding the guide plate portion, the vertical trench's edges facing the step portions being cut out such that the guide plate portion is released from the guiding portion when the male screw's tip is coupled to the terminal strip.

Advantageously, each of the swinging means comprises:

a first swinging mechanism including taper portions formed on both sides of the guide plate portion of the L-shaped washer such that the guide plate portion's width narrows toward the portion's upper edge thereof;

a protrusion formed on the guide plate portion, the protrusion extending opposite to the male screw; and a fourth swinging mechanism including a vertical slit for guiding the protrusion, the slit being widened downward.

Advantageously, the terminal cover and the electrical apparatus's arc quenching cover are integrated into a unitary.

The washer loosely supported on the terminal screw has a guide plate portion extending opposite to the terminal strip. The guide plate portion is supported on the vertical trench formed on the terminal cover such that the guide plate portion is movable linearly. This configuration facilitates arranging the guiding portion and coupling claw for the terminal screw inside the terminal device. The terminal device includes a terminal cover which has the round holes for handling the terminal screws on a first side face, and insertion holes for accepting the electric conductors on a second side face perpendicular to the first side face. During the shipment of the electrical apparatus, the male screw is held at a predetermined position by the coupling claw. Since the tip of the terminal screw is always guided by the guiding portion toward the screw hole of the fixed terminal, the terminal screw is tightened up or loosened to resume the predetermined position efficiently without being dropped. Since the guide plate portion of the L-shaped washer is released by the swinging means from the guiding portion when the male screw is coupled with the terminal strip, the L-shaped washer tilts to exert enough cramping force to two conductor ends to be connected in parallel even when the conductors are different from each other in diameter.

By forming the swinging means of a first swinging mechanism which includes taper portions formed on both sides of the guide plate portion of the L-shaped washer such that the width of the guide plate portion narrows toward the upper edge of the guide plate portion, a space is created between the taper portions and the guiding portion, when the guide plate portion is lowered below the lower edge of the guiding portion. In this state, the L-shaped washer is able to swinging in the created space to exert enough cramping force to two conductor ends to be connected in parallel even when the conductors are different from each other in diameter.

By forming the swinging means of a second swinging mechanism including the thin side portions of the guide plate portion and the taper portions formed on the sides of the thin side portion, and a third swinging mechanism including the vertical trench, to which the thin side and the step portions of the guide plate portion are coupled, the edges of the vertical trench facing the step portions being cut out such that the width of the vertical trench is widened downward, highly precise guiding of the guide plate portion is facilitated in a small space. Since the second and third swinging mechanisms function complementarily to release the L-shaped washer, the L-shaped washer tilts to exert enough cramping force to the conductor end having smaller diameter.

By forming the swinging means of a first swinging mechanism including taper portions formed on both sides of the guide plate portion of the L-shaped washer such that the guide plate portion's width narrows toward the portion's upper edge thereof; a protrusion formed on the guide plate portion, the protrusion extending opposite to the male screw, and a fourth swinging mechanism including a vertical slit widened downward, the protrusion lowered to the widened part of the vertical slit, i.e. located in the fourth swinging mechanism, allows the L-shaped washer to tilt. Therefore, enough cramping force is exerted even to the conductor end having smaller diameter. When loosening to remove the terminal screw to the coupling claw, the protrusion easily returns to the slit.

BRIEF DESCRIPTION OF THE DRAWINGS

The above and other objects and features of the present invention will be more apparent from the following description taken in conjunction with the accompanying drawings.

DETAILED DESCRIPTION OF THE PREFERRED EMBODIMENTS

Now, the present invention will be described in detail hereinafter with reference to the accompanying drawings which illustrate the preferred embodiments of the present invention.

Figure 1:
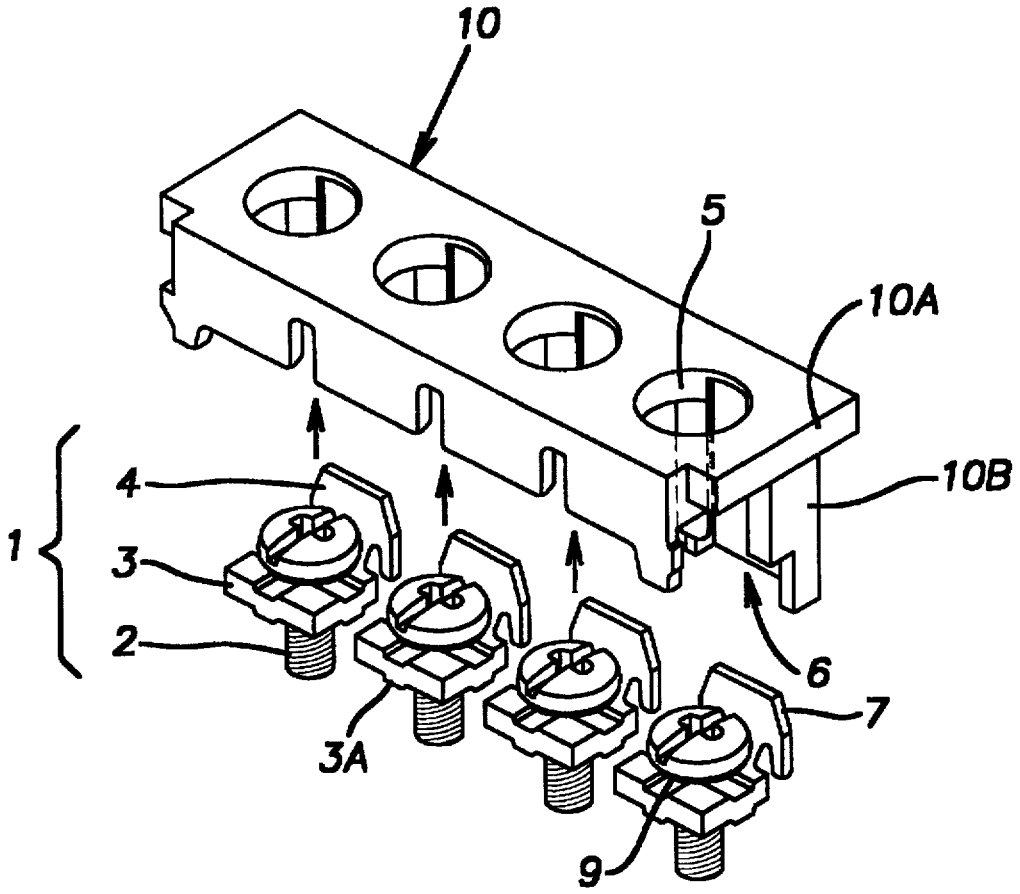
FIG. 1 is an exploded perspective view showing a terminal device according to a first embodiment of the present invention.
Figure 2:
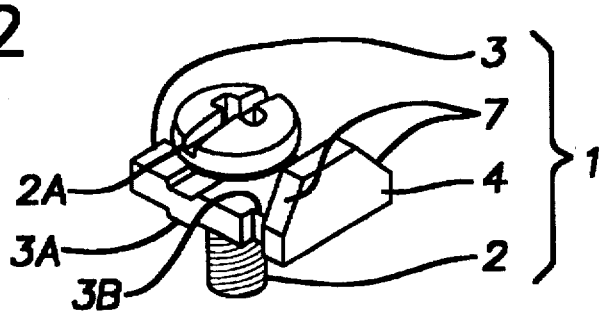
FIG. 2 is a perspective view showing the terminal screw of FIG. 1, viewed from a different angle.

FIG. 1 is an exploded perspective view showing a terminal device according to a first embodiment of the invention. FIG. 2 is a perspective view showing the terminal screw of FIG. 1, viewed from a different angle. In these figures, a terminal screw 1 is comprised of a male screw 2, an L-shaped washer 3 supported loosely and rotatably on the male screw 2, and a spring washer 9. The L-shaped washer 3 includes a square flat washer portion, on the bottom surface of which a pressing nails 3A is formed, and a guide plate portion 4 extending perpendicularly from an edge of the flat washer portion to the side opposite to the terminal strip (upward in the figures). The guide plate portion 4 has a swinging mechanism that includes tapered portions 7 formed on both sides of the guide plate portion 4 such that the width of the guide plate portion 4 reduces towards the upper edge of the guide plate portion 4. The guide plate portion 4 also has a notch portion 3B on a boundary between the flat washer portion and the guide plate portion. A terminal cover 10 made of an insulating material is provided for preventing finger tips from electrification. Round holes 5, through which a screwdriver is inserted, are formed on an upper plate 10A of the terminal cover 10. The round holes 5 are so defined as to be a little bit larger in diameter than the head 2A of the male screw 2. A plurality of each guiding portions 6 having a vertical trench therein are formed in a side plate 10B of the terminal cover 10. Each of the vertical trenches have an opening facing inwardly toward the associated round hole 5.

Figure 3:
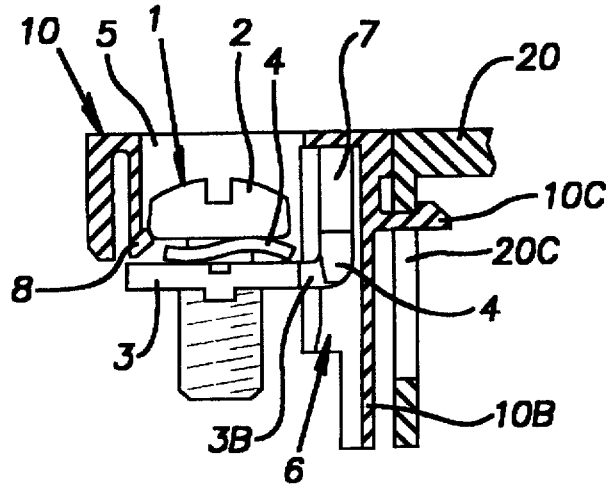
FIG. 3 is a cross-sectional view showing an assembly of the parts shown in FIG. 1.

FIG. 3 is a cross-sectional view showing an assembly of the parts shown in FIG. 1. Referring to FIG. 3, when the guide plate portion 4 of the terminal screw 1 is inserted upward into the guiding portion 6, the opening's edge of the vertical trench of the guiding portion 6 and the notch portion 3B defined on a boundary between the flat washer portion and the guide plate portion couple with each other such that the guide plate portion 4 is surrounded by the trench wall, and the terminal screw 1 is guided along the vertical trench. The terminal cover 10 has a coupling claw 8 formed by extending the inner wall of the round hole 5 downward and by providing the extended inner wall with elasticity. As the tip of the coupling claw 8 couples with the bottom surface of the head of the male screw 2, the terminal screw 1 is held at a predetermined position. Thus, the terminal screw 1 is incorporated into the terminal cover 10. The terminal cover 10 has hooks 10C protruding sidewise from the side plate of the cover 10. Reference numeral 20 designates an arc quenching cover of an electromagnetic switch as an example of the electrical apparatus. The arc quenching cover 20 has a hole 20C. The terminal cover 10, into which the terminal screw 1 is incorporated, is installed on the electromagnetic switch via the arc quenching cover 20 by coupling the hook 10C with the edges of the holes 20C.

Figure 4:
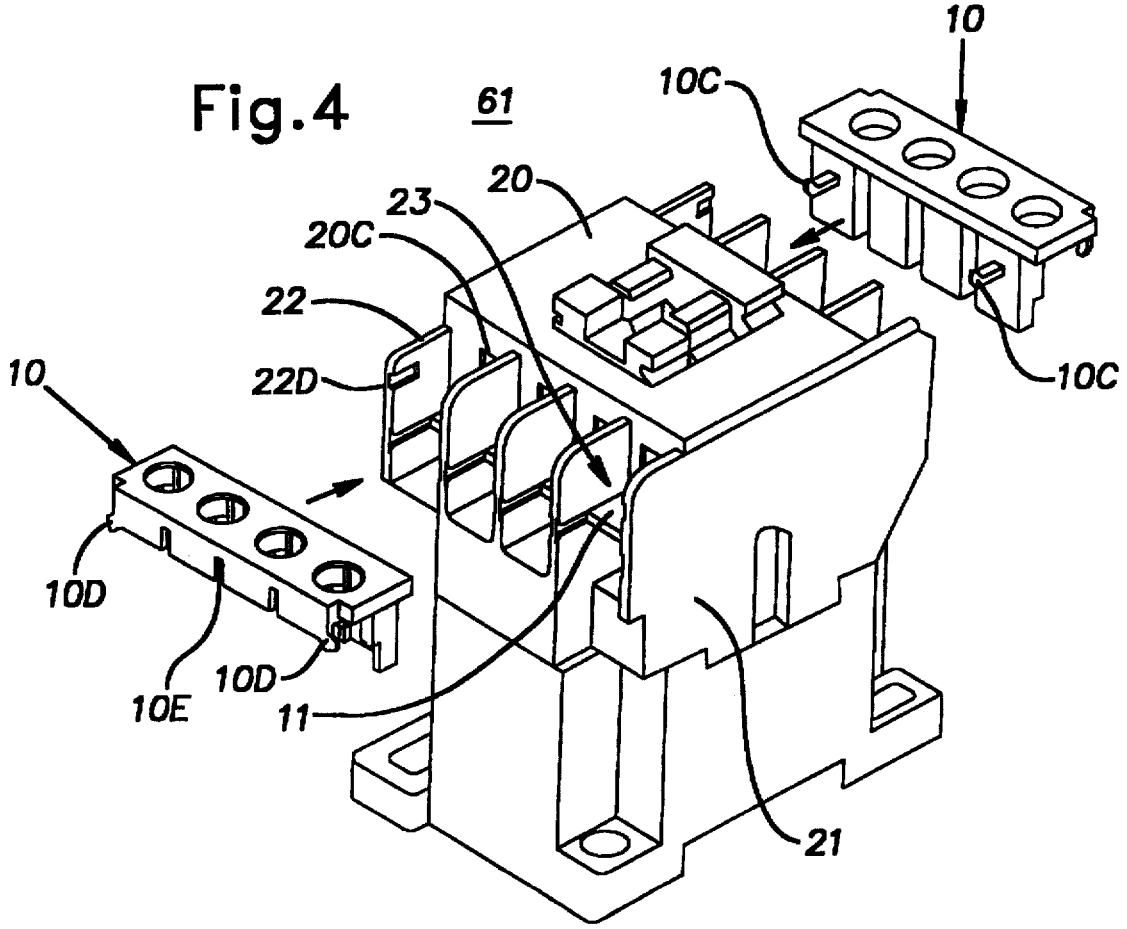
FIG. 4 is an exploded perspective view showing the installation of the terminal device of FIG. 3 to an electromagnetic switch.

FIG. 4 is an exploded perspective view showing the installation of the terminal device of FIG. 3 to an electromagnetic switch. Referring now to FIG. 4, the electromagnetic switch 61 includes a frame 21 having terminal housing portions 23 which are separated from one another by insulating walls including phase separation walls 22 and the arc quenching cover 20. A terminal strip 11 having a screw hole (not shown) bored in the central part of the strip, is fixed to inside each of the terminal housing portions 23. A trench 22D is formed on the phase separation wall 22. As described earlier, the hole 20C is bored on the arc quenching cover 20. Protrusions 10D are formed on the corners of the terminal cover 10. Notch portions 10E are formed on the side plate of the terminal cover 10 corresponding to the phase separation walls 22. The terminal device is installed on the electromagnetic switch 61 by inserting the terminal cover 10 along the frame 21 such that the protrusions 10D, the hooks 10C and the notch portions 10E couple respectively with the trenches 22D, holes 20C and the phase separation wall 22. Alternatively, the terminal cover 10 and electromagnetic switch are constructed so that the terminal cover may be installed downward onto the electromagnetic switch.

Figure 5A:
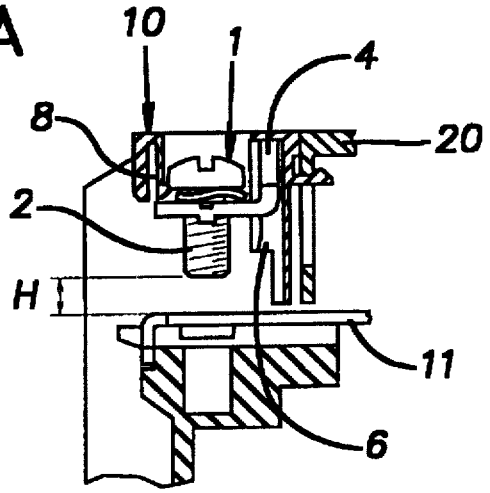
FIG. 5A is a cross-sectional view showing the terminal device in its waiting state according to the first embodiment.
Figure 5B:
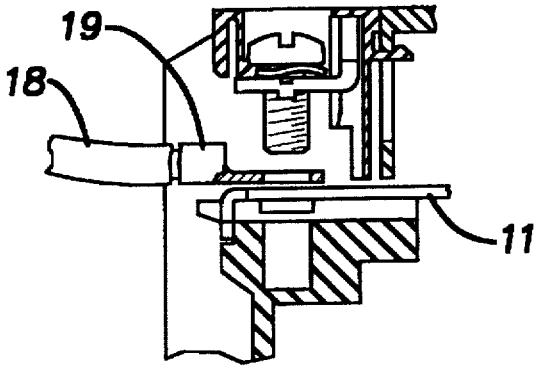
FIG. 5B is a cross-sectional view showing the terminal device to which the crimp terminal is inserted according to the first embodiment.
Figure 5C:
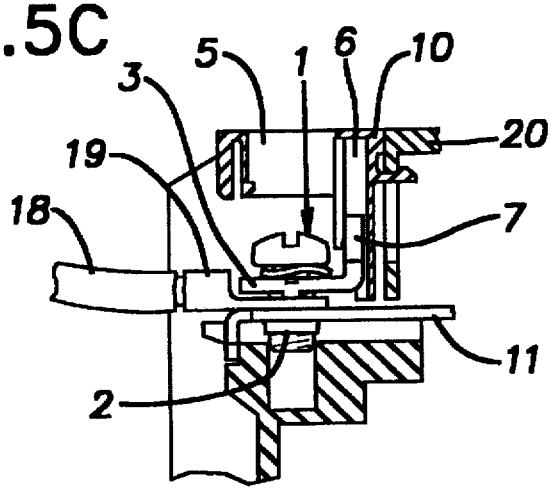
FIG. 5C is a cross-sectional view showing of the terminal device to which the crimp terminal has been connected according to the first embodiment.

FIGS. 5A to 5C illustrate the steps for connecting an annular crimp contact to the above described terminal device of the invention. FIG. 5A illustrates the waiting state. FIG. 5B illustrates the state when the crimp terminal is inserted into the terminal device. FIG. 5C illustrates the state when the connection of the crimp terminal to the terminal device is completed. Referring to FIG. 5A, the guide plate portion 4 is inserted upward into the guiding portion 6 of the terminal cover 10. The terminal screw 1 is guided up to a position where the bottom surface of the head of the male screw 2 couples with the coupling claw 8. Then, a spacing H necessary for composite wiring of a bare conductor and an annular crimp contact or for lap wiring of two annular crimp contacts is secured between the tip of the male screw 2 and the terminal strip 11. The terminal device is shipped in the waiting state shown in FIG. 5A. Therefore, in the labor of connecting electric wiring terminal, the work for loosening the male screw 2 coupled with the terminal strip 11 from the terminal strip 11 is eliminated, and number of steps for wiring connection is reduced. Referring now to FIG. 5B, an annular crimp contact 19 electrically connected with the end of an electric conductor 18 is inserted into the space H, and the tip of the male screw 2 is inserted into the hole of the crimp contact 19. Referring now to FIG. 5C, the male screw 2 is pushed down with a screwdriver inserted into the round hole 5 to disengage the head of the male screw 2 from the coupling claw 8. Since the guide plate portion 4 of the terminal screw 1, being pushed down, is guided by the guiding portion 6, the terminal screw 1 is guided, without turning over, toward the screw hole of the terminal strip 11 until the male screw 2 reaches the screw hole. After the terminal screw 1 has reached the screw hole, the male screw 2 is tightened up to press and fix the annular crimp contact 19 firmly between the terminal strip 11 and the L-shaped washer 3.

When disengaging the annular crimp contact 19, the male screw 2 is loosened and the terminal screw 1 is pushed up, e.g. by a screwdriver or the like inserted below the L-shaped washer 3 until the terminal screw 1 couples with the coupling claw 8. Then, the annular crimp contact 19 is pulled out. The guide plate portion 4 of the terminal screw 1 is guided by the guiding portion 6 of the terminal cover 10 all the time during these steps. Therefore, the annular crimp contact 19 is disengaged smoothly without causing troubles such as turning over and dropping out of the terminal screw 1.

In FIG. 5C, the guide plate portion 4 is lowered below the lower edge of the guiding portion 6 to create a space between the tapered portions 7 formed on the both sides of the guide plate portion 4 and the guiding portion 6. Now, the L-shaped washer 3 is able to swing in the created space. Therefore, when the ends of bare conductors, different in diameter from each other, are connected in parallel, or when an end of a bare conductor and an annular crimp contact are lap-connected, the L-shaped washer facilitates tilting to the smaller diameter side to exert enough cramping force to the conductor with smaller diameter.

Figure 6:
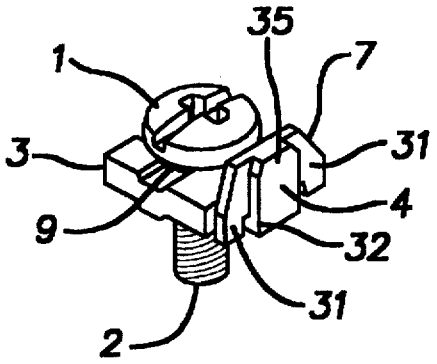
FIG. 6 is a perspective view showing a terminal screw according to a second embodiment of the present invention.
Figure 7:
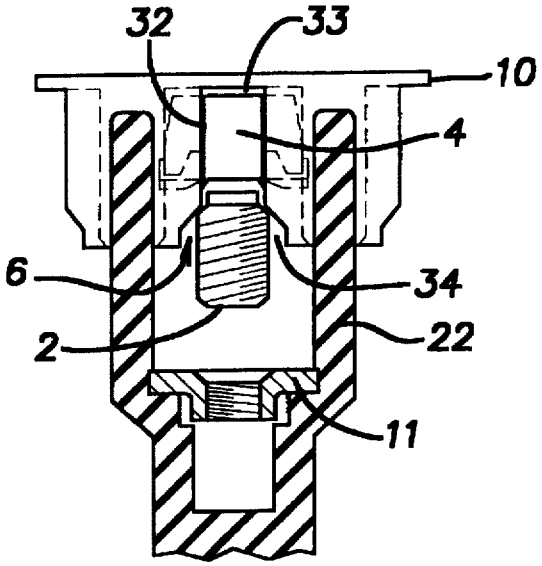
FIG. 7 is a cross-sectional view illustrating the waiting state of the terminal device according to the second embodiment.
Figure 8:
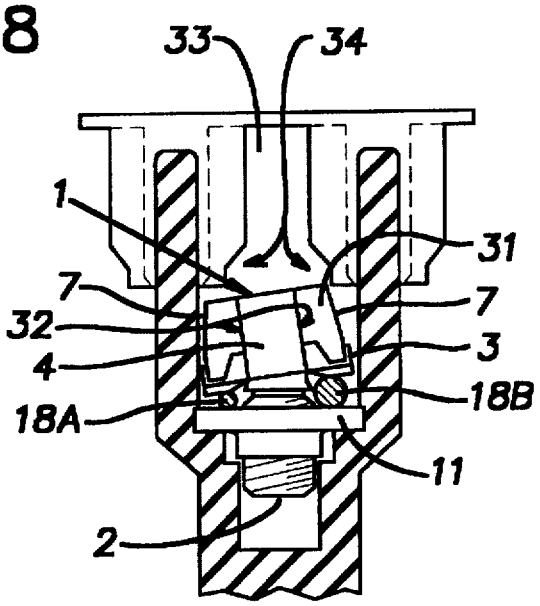
FIG. 8 is a cross-sectional view illustrating the completed state of connection in the terminal device according to the second embodiment.

A terminal device according to a second embodiment of the invention will be explained below with reference to FIGS. 6 to 8. FIG. 6 is a perspective view showing the terminal screw according to the second embodiment. FIG. 7 is a cross-sectional view illustrating the waiting state of the terminal device of the second embodiment. FIG. 8 is a cross-sectional view illustrating the completed state of connection in the terminal device of the second embodiment. Referring now to FIG. 6, a terminal screw 1 includes an L-shaped washer 3 having a guide plate portion 4. The guide plate portion 4 is formed thinner on both sides thereof such that a step portion 32 is formed between a thin side portion 31 and a thick central portion 35. The guide plate portion 4 has a second swinging mechanism which includes tapered portions 7 formed on both sides of the guide plate portion 4 (on the side edge of the thin side portions 31) such that the width of the guide plate portion 4 reduces toward the upper edge of the guide plate portion 4. Referring now to FIG. 7, a guiding portion 6 includes a vertical slit 33 formed on a side plate of a terminal cover 10. The vertical slit 33 has a width corresponding to the width of the thick central portion 35 of the guide plate portion 4. The guiding portion 6 surrounds the thin side portions 31 including the step portions 32 to guide the terminal screw 1 vertically along the slit 33. The slit 33 is expanded sidewise in the lower part thereof to form a third swinging mechanism 34.

As mentioned earlier, FIG. 8 is a cross-sectional view showing the thus structured terminal device which connects bare ends 18A and 18B of electric conductors, different from each other in diameter, between a terminal strip 11 and the L-shaped washer 3. At first, the bare ends 18A and 18B are inserted between the terminal strip 11 and the L-shaped washer 3. Then, the terminal screw 1 is pushed down from the predetermined position where the terminal screw 1 has been held by a not shown coupling claw. The guide plate portion 4 of the terminal screw 1 is guided vertically by means of its thick central portion 35 fitted in the slit 33. When the upper edge of the guide plate portion 4 reaches the second swinging mechanism, guide plate portion 4 is released from the slit 33. The L-shaped washer 3 tilts to be positioned stably where its pressing nails contact the respective bare ends 18A and 18B. Then, clamping force is exerted to the bare ends 18A and 18B by tightening up the male screw 2 to securely fix the bare ends, different in diameter, on the terminal device. An annular crimp contact and a bare end of a conductor are lap-connected in the same manner to the terminal device.

Figure 9:
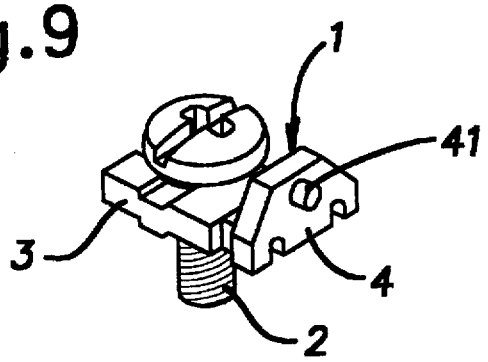
FIG. 9 is a perspective view showing a terminal device according to a third embodiment of the invention.

FIG. 9 is a perspective view showing a terminal device according to a third embodiment of the invention. The terminal device of FIG. 9 is different from the terminal device of FIG. 6 in that a guide plate portion 4, having tapered portions 7 (the first swinging mechanism), of an L-shaped washer 3 has a uniform thickness, and a cylindrical protrusion 41 is disposed in the vicinity of the upper edge on the back surface of the guide plate portion 4. The cylindrical protrusion 41 is disposed for the substitution of the thick central portion 35 of the second embodiment. By forming the slit 33 of FIG. 7 or 8 such that the cylindrical protrusion 41 fits the slit 33 and by widening the slit width in the lower part to form a fourth swinging mechanism, the same functions and effects with those of the second embodiment explained with reference to FIGS. 6 to 8 are obtained.

Figure 10:
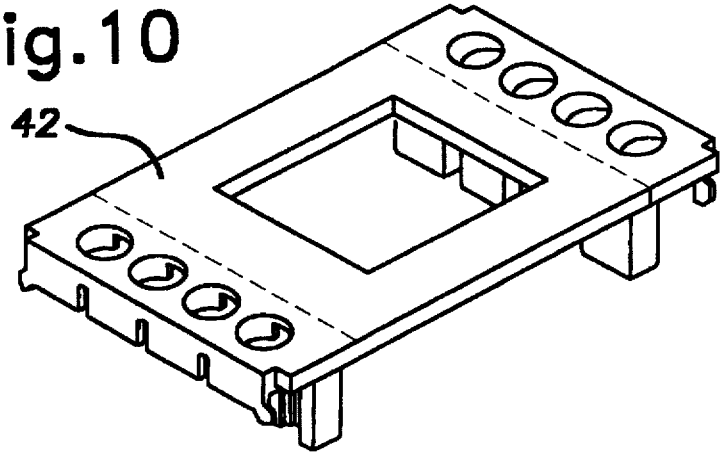
FIG. 10 is a perspective view showing a terminal device according to a fourth embodiment of the invention.
Figure 11:
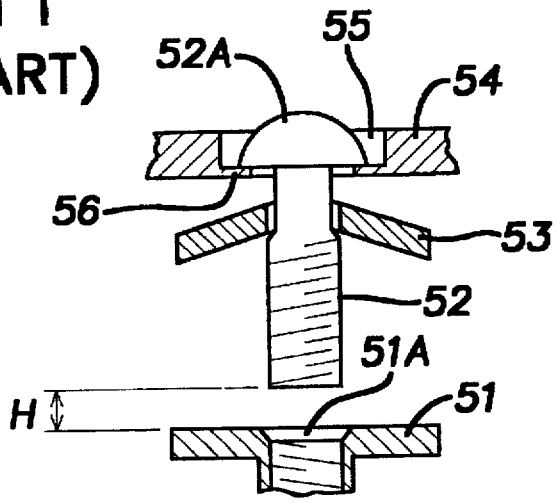
Fig.11 (PRIOR ART)
FIG. 11 is a schematic cross-sectional view showing a main part of an example of the conventional terminal devices.
Figure 12:
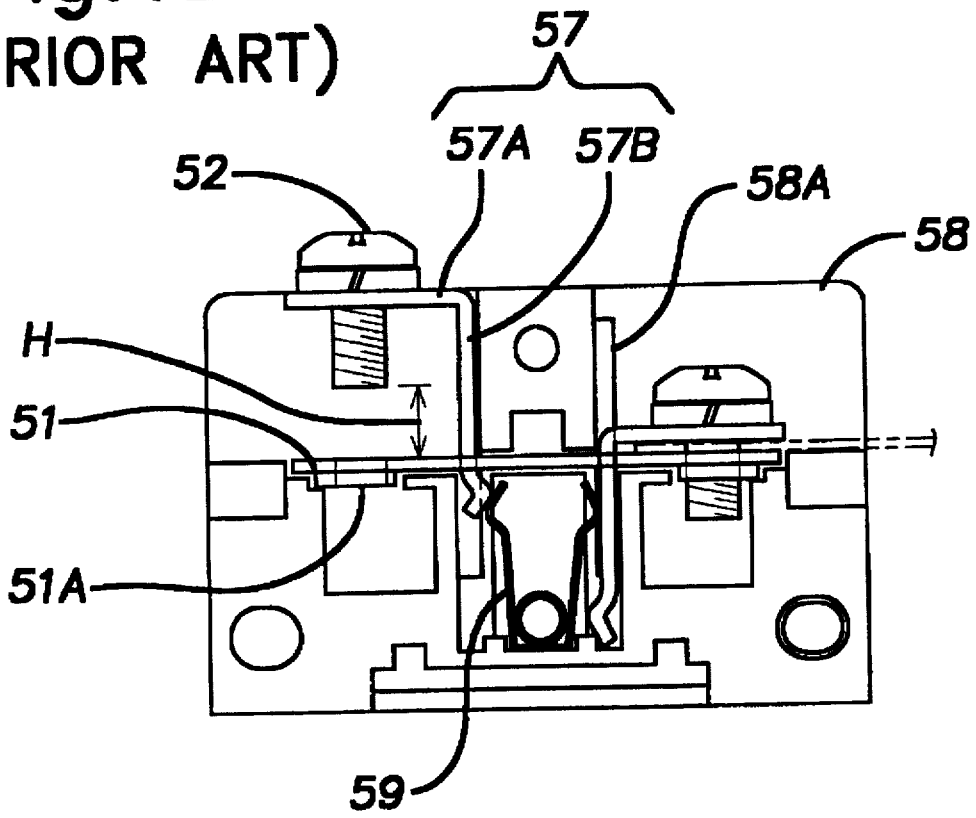
Fig.12 (PRIOR ART)
FIG. 12 is a schematic cross-sectional view showing a main part of another conventional terminal device.
Figure 13:
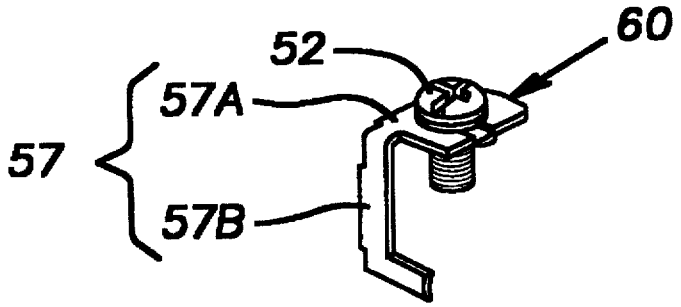
Fig.13 (PRIOR ART)
FIG. 13 is a perspective view showing the terminal screw of FIG. 12.

FIG. 10 is a perspective view showing a terminal device according to a fourth embodiment of the invention. The terminal device of FIG. 10 is different from the terminal device of FIGS. 1 to 5C in that the terminal cover 10 of the first embodiment and the arc quenching cover 20 are integrated into a unitary terminal cover 42. With this integration, the number of parts and elements of the electromagnetic switch is reduced, In addition, since the parts and elements such as hooks 10C and holes 20C for engaging or disengaging the terminal device with or from the electrical apparatus are unnecessary, the structure of the terminal device is simplified.

As was described above, according to the present invention, the terminal device for an electrical apparatus is so designed that, since the guiding portion and coupling claw for the terminal screw are disposed inside the terminal cover which has been conventionally provided only to prevent finger tips from electrification, the terminal device having the holding function and guiding function for the terminal screw can be downsized. Moreover, such a situation that the terminal screw is fell out, turned out or lost, from which the conventional terminal device has suffered, is avoidable, and in connecting the annular crimp contact, the work for disengaging the terminal screw from the terminal strip is removable. As a result, the present invention can provide an electric device having a terminal device which is downsized and high in the work efficiency for connection of wiring.

By disposing the first swinging mechanism, second and third mechanisms, or first and fourth swinging mechanisms between the guide plate portion and the guiding portion, a terminal device is provided for the electrical apparatus, which terminal device facilitates connecting, efficiently and securely, bare ends of electric conductors having different diameters in parallel or an annular crimp contact and a bare end of an electric conductor one over the other.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A terminal device for connecting contacts to terminal strips of an electrical apparatus, each of the terminal strips having a screw hole and being separated by insulating walls from one another, said terminal device comprising:

a plurality of terminal screws, each including a male screw, and an L-shaped washer supported loosely and rotatably on said male screw and having a guide plate portion extending opposite to the terminal strip;

a terminal cover for covering the terminal screws, said cover having round holes for handling the respective terminal screws;

guiding portions, each of said guiding portions including a vertical trench formed in a side plate of said terminal cover and having an opening facing one of the round holes, said guiding portions being operable to guide one of said guide plate portions slidably to and from the terminal strip along said vertical trench;

a plurality of coupling claws, each of said claws being disposed between said round hole and said male screw, said claws being adapted to hold said terminal screw such that a tip of said male screw is spaced a distance from the terminal strip; and means for releasing said guide plate portions from said guiding portions when the tips of said male screws are coupled to the respective terminal strips.

2. A terminal device as claimed in claim 1, wherein each of said releasing means comprises a first swinging mechanism including tapered portions formed on both sides of said guide plate portion of said washer such that a width dimension of said guide plate portion narrows toward an upper edge of said guide plate portion.

3. A terminal device as claimed in claim 1, wherein each of said releasing means comprises: a second swinging mechanism including said guide plate portion formed of thin side portions, a thick central portion and stepped portions disposed between the thin side portions and thick central portions, and tapered portions formed on a side of said thin side portions such that the width of said guide plate portion narrows toward the upper edge thereof; and a third swinging mechanism including said vertical trench to which said thin side portions and said step portions are coupled, edges of said vertical trench facing the step portions being cut out such that said guide plate portion is released from the guiding portion when said male screw is coupled to the terminal strip.

* * * * *